US006755690B1

(12) United States Patent
Zhang

(10) Patent No.: US 6,755,690 B1
(45) Date of Patent: Jun. 29, 2004

(54) ELECTRICAL CONNECTOR HAVING GROUNDING BRIDGE

(75) Inventor: Ease Zhang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/409,533

(22) Filed: Apr. 7, 2003

(30) Foreign Application Priority Data

Apr. 2, 2003 (TW) ..... 92205203

(51) Int. Cl.[7] ..... H01R 13/648
(52) U.S. Cl. ..... 439/607
(58) Field of Search ..... 439/607, 609, 439/610, 108

(56) References Cited

U.S. PATENT DOCUMENTS 6,390,833 B1 5/2002 Chang

*Primary Examiner*—Javaid H. Nasri
(74) *Attorney, Agent, or Firm*—Wei Te Chung

(57) ABSTRACT

An electrical connector (100) adapted for mating with a complementary connector having a shield comprises an insulative housing (21), a metallic shell (1), a number of terminals (22) mounted to the housing and at least one grounding bridges (3). The housing comprises a base (211) and a mating portion (212) defining a receiving cavity (2121) and at least one fixing portion (214). Each grounding bridge has a body portion (31) retained in the at least one fixing portion, a contact portion (32) extending beyond an upper portion of the housing, and a fastening portion (35) extending horizontally from the bottom of the body portion and abutting against the metallic shell. The contact portion of the grounding bridge engages with the shield of the mating connector before the terminals electrically connect with contacts of the mating connector.

1 Claim, 5 Drawing Sheets

ELECTRICAL CONNECTOR HAVING GROUNDING BRIDGE

CROSS-REFERENCES TO RELATED APPLICATIONS

This application is related to a co-pending U.S. Patent application entitled "ELECTRICAL CONNECTOR HAVING GROUNDING BRIDGE". filed on Jan. 8, 2003, with a Ser. No. 10/339,532, and assigned to the common assignee of the present invention.

BACKGROUND OF THE INVENTION

1. Field of the Invention

The present invention relates to electrical connectors and more particularly, to an electrical connector having grounding bridges for Electro-Static Discharge (SD).

2. Description of Related Art

With ever-increasing operating frequencies of data and communication systems and an increased density of information to be transmitted, electronic characteristics of electrical connectors are of increasing importance. Electrical connectors usually have guiding column to be inserted into guiding apertures of mating connectors. Grounding bridges are provided on the guiding columns for contacting with grounding members of the mating connector for Electro-Static Discharge (ESD).

U.S. Pat. No. 6,390,833 issued to Chang on May 21, 2002 discloses an electrical connector having grounding pad for ESD. Each grounding pad includes a vertical body, a first foot extending downwardly and outwardly from a lower end of the body and electrically connecting with an inner side of a shield, and a second foot extending upwardly and outwardly from the body to electrically engage with a shield of a mating connector. However, the grounding pads are mounted on the housing only by the bodies abutting against corresponding blocks of the housing, which increase the difficulty of orientation during assembly of the shield.

Hence, an electrical connector with improved grounding bridges with reliably retention means is desired.

SUMMARY OF THE INVENTION

An object of the present invention is to provide an electrical connector having grounding bridges for ESD which can be reliably retained therein and assure an electrical connection with a shield of a mating connector.

In order to achieve the above object, an electrical connector according to the present invention comprises an insulative housing, a metallic shell, a number of terminals mounted to the housing and at least one grounding bridge. The housing comprises a base and a mating portion defining a receiving cavity and at least one fixing portion. Each grounding bridge has a body portion retained in the at least one fixing portion, a contact portion extending beyond an upper portion of the housing, and a fastening portion extending horizontally from the bottom of the body portion and abutting against the metallic shell. The contact portion of the grounding bridge engages with the shield of the mating connector before the terminals electrically connect with contacts of the mating connector.

Other objects, advantages and novel features of the invention will become more apparent from the following detailed description of a preferred embodiment when taken in conjunction with the accompanying drawings.

DETAILED DESCRIPTION OF THE PREFERRED EMBODIMENTS

Figure 1:
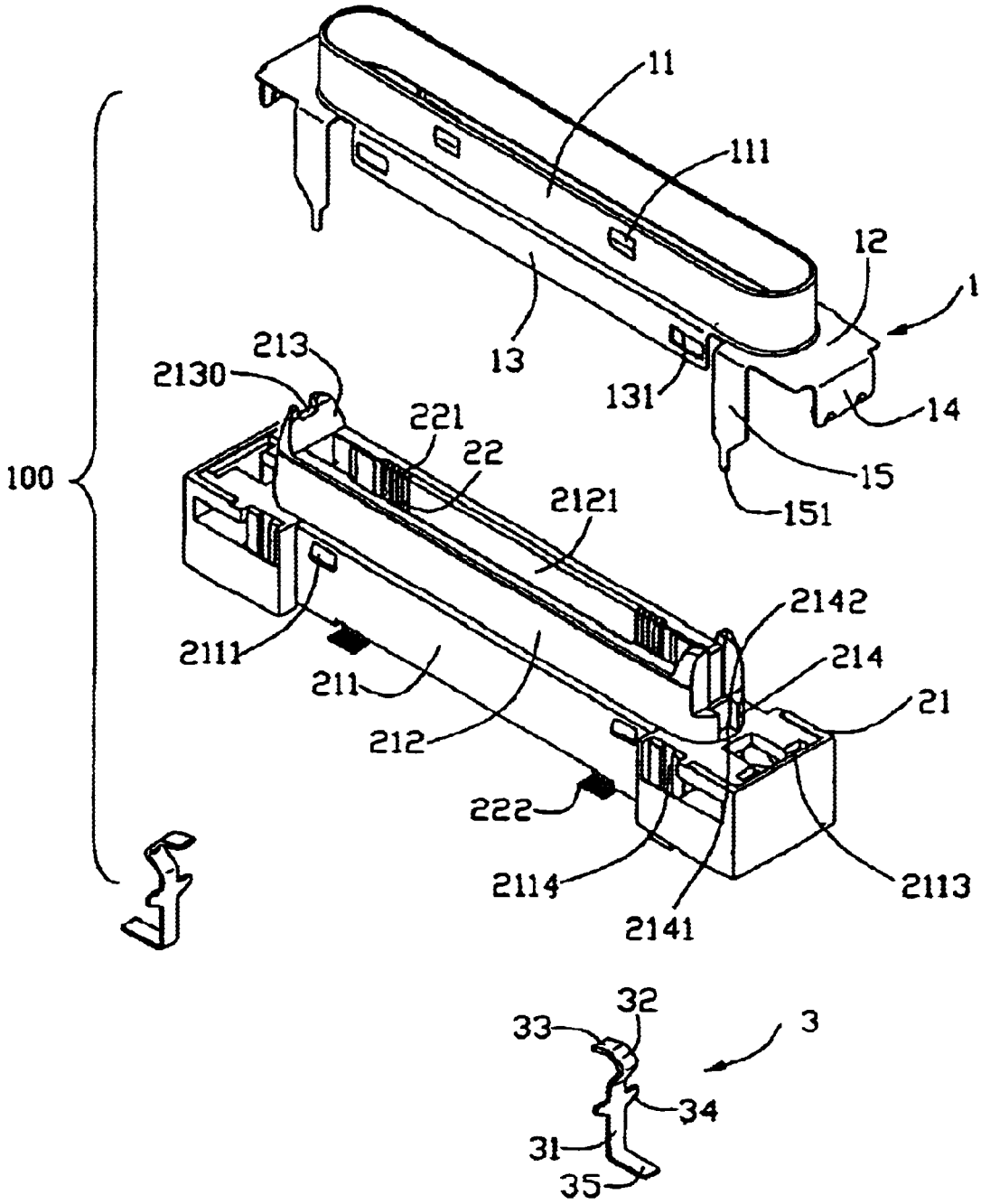
FIG. 1 is an exploded view of an electrical connector according to the present invention.
Figure 4:
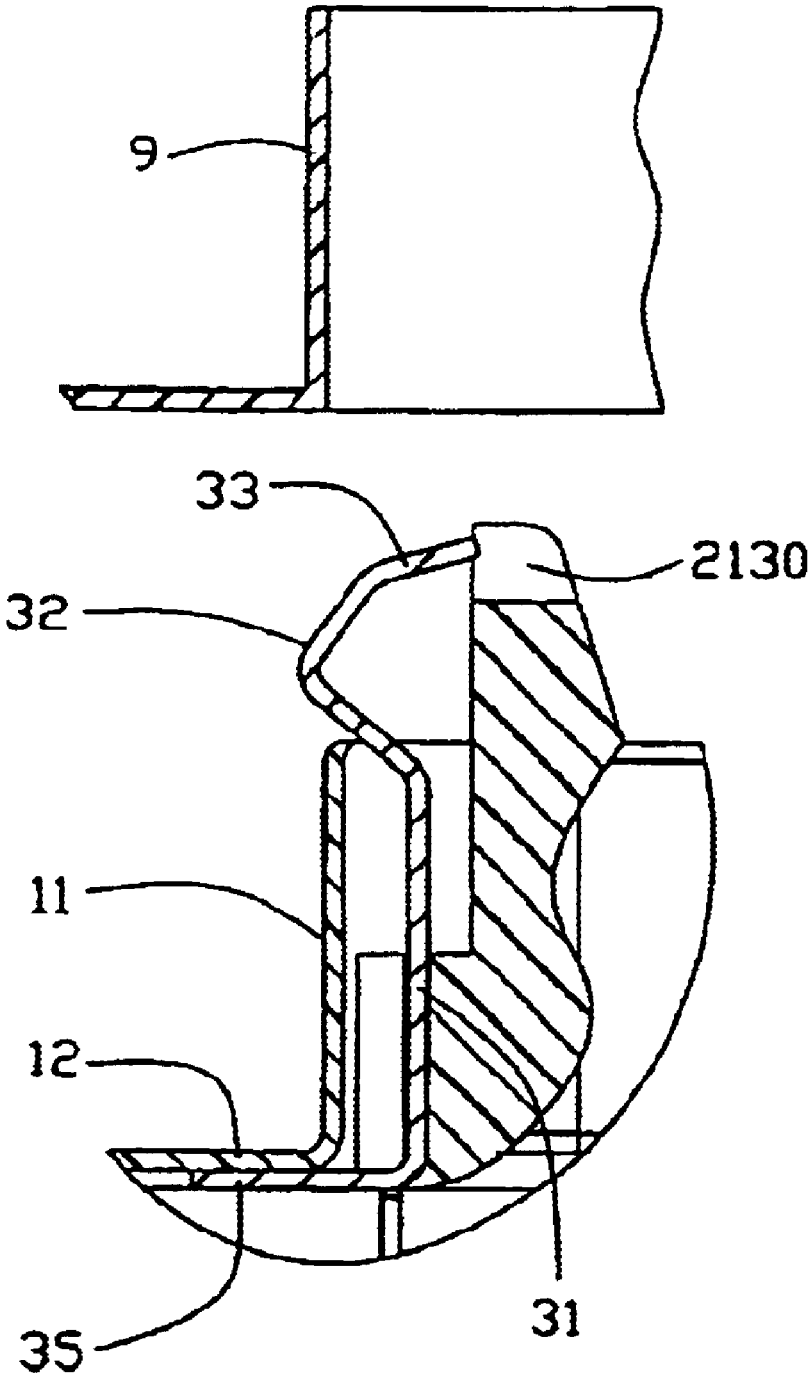
FIG. 4 is a cross-sectional view of the electrical connector and a mating connector before the mating connector is inserted into the electrical connector.

Referring to FIGS. 1 and 4, an electrical connector 100 in accordance with the present invention is adapted to mate with a mating connector (not labeled).

The electrical connector 100 comprises an insulative housing 21, a plurality of terminals 22 received in the housing 21, a metallic shell 1 attached to the housing 21 and a pair of conductive grounding edges 3 mounted on the housing 21.

The metallic shell 1 includes a hollow cover 11, a horizontal roof 12 extending outwardly from a bottom portion of the cover 11, and a pair of flaps 13 extending downwardly from opposite elongated sides of the cover 11. The cover 11 forms a plurality of projections 111 on an outer periphery thereof. Each flap 13 defines a plurality of cutouts 131. The roof 12 has a pair of side plates 14 extending downwardly from opposite sides thereof. A plurality of grounding pad 15 extend downwardly from the roof 12 with grounding tails 151 extending downwardly thereof.

Figure 2:
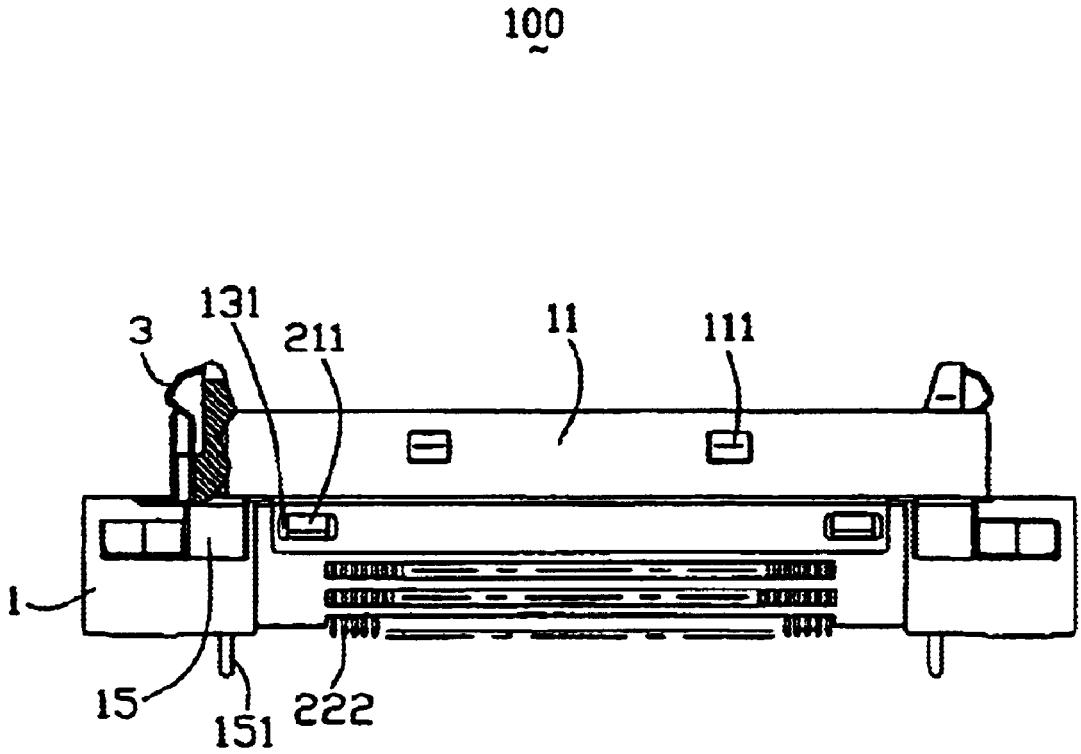
FIG. 2 is a partially cross-sectional view of the electrical connector of FIG. 1 taken from a front aspect.
Figure 3:
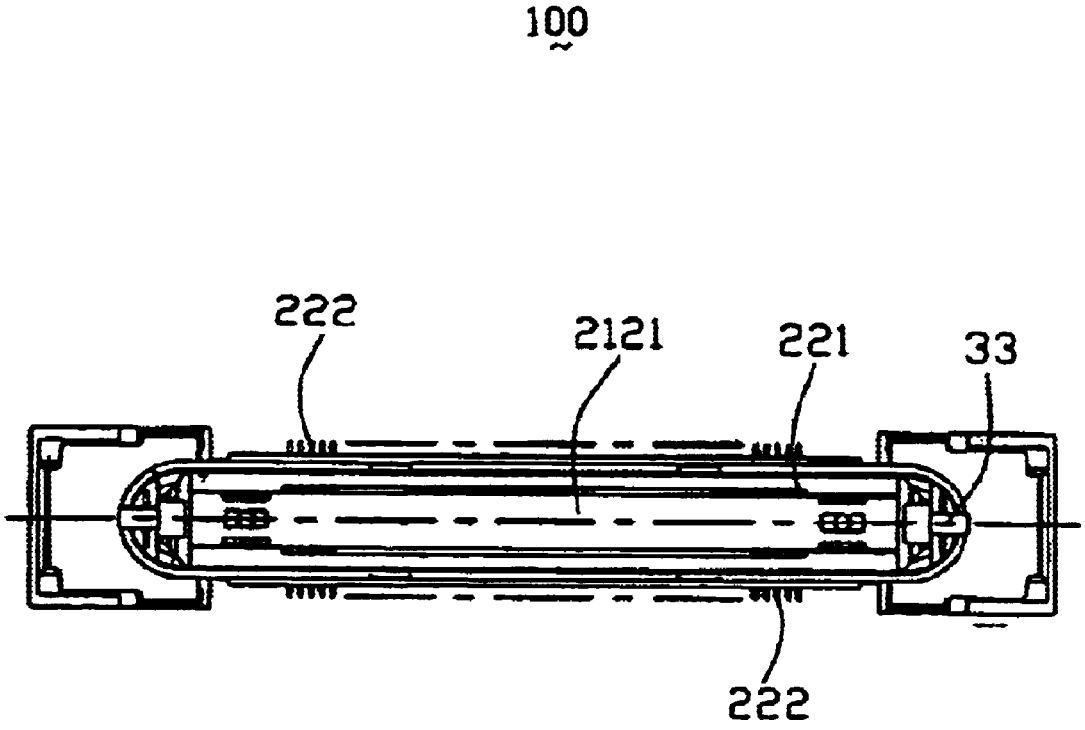
FIG. 3 is a top plan view of the electrical connector.

Referring to FIGS. 1, 2 and 3, the insulative housing 21 includes an elongated base 211 and a mating portion 212 projecting upwardly from the base 211. The base 211 forms a plurality of barbs 2111 corresponding to the cutouts 131 of the metallic shell 1. The base 211 further defines a first and second channels 2113, 2114 in opposite side portions therein. The mating portion 212 defines a longitudinal receiving cavity 2121 for receiving the mating connector. Two rows of terminal passageways (not labeled) are defined in opposite inner peripheries of the mating portion 212. The mating portion 212 further has a pair of guiding columns 213 on opposite ends of the mating portion 212. Each guiding column 213 defines a notch 2130 in an upper portion thereof and a fixing portion 214 in a lower portion thereof. Each fixing portion 214 has a slot 2141 and a retaining recess 2142 extending outwardly from the inner side of the slot 2141.

Each terminal 22 includes a main portion 221 received in a corresponding terminal passageway with contact portions exposed in the terminal passage for engaging with the mating connector and a solder tail 222 extending outwardly from a bottom portion of the main portion 221.

Each grounding bridge 3 includes a vertical body portion 31, a curved contact portion 32 extending inwardly from an upper end of the body portion 31, a pair of wings 34 extending from opposite sides of the body portion 31, a horizontal shift portion 33 extending inwardly from a free end of the contact portion 32, and a planar fastening portion 35 extending outwardly from a bottom portion of the body portion 31.

In assembly, the terminals 22 are received in the terminal passageways of the mating wall 212. The grounding bridges 3 are mounted to the insulative housing 21. The body portion 31 of each grounding bridge 3 is inserted into a corresponding slot 2141 and the wings 34 are retained in the retaining recess 2142. The fastening portion 35 extends out of the slot 2141 and abuts against an upper surface of the housing 21 for electrically connecting with the shell 1. The shift portion 33 is located in the notch 2130 of the guiding column 213 of the housing 21 for facilitate an inwardly movement of the contact portion 32. The contact portions 32 of the grounding bridges 3 are exposed from the opposite end of the housing 1 for electrically engaging with a shield 9 (shown in FIGS. 4, 5) of the mating connector.

The hollow cover 11 of the shell 1 encloses the mating portion 212 of the housing 21. The side plates 14 are inserted into the fit channels 2113. The cutouts 131 of the flaps 13 engage with the barbs 2111 of the base 211. The grounding pads 15 are inserted into the second channels 2114 and the grounding tails 151 extending beyond the bottom surface of the housing 21. The roof 12 abuts tightly against the fastening portion 35 to the upper surface of the housing 21.

Figure 5:
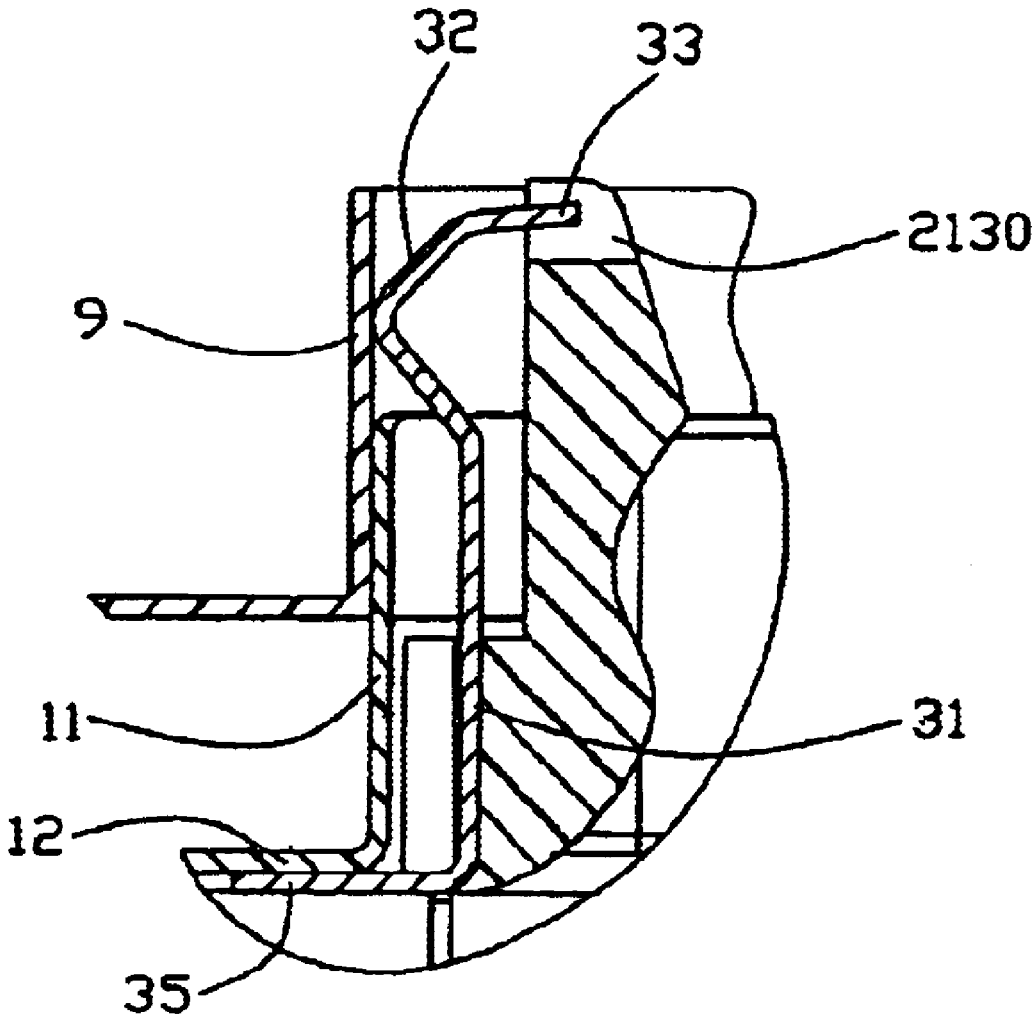
FIG. 5 is another cross-sectional view of the electrical connector and a mating connector, wherein the mating color is partially inserted into the electrical connector.

When the mating connector is inserted into the electrical connector 100, as is shown in FIGS. 4 and 5, the mating shield 9 contacts the contact portions 32 of the grounding bridges 3 of the electrical connector 100, and then the shift portions 33 of the grounding bridges 3 are pressed into the notches 2130 of the guiding column 23. The terminals (not shown) of the mating connector engage with corresponding teals 22 of the electrical connector 100 thereafter. Therefore, the static electronics deposited on the connectors are discharged prior to data transmitting and power current flowing between the electrical connector 100 and mating connector. Since the body portions 31 of the grounding bridges 3 are received and secured in the slots 2141 in the fixing portion 214, a reliable electrical connection between the grounding bridges 3 and the mating shield 9 is obtained.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. An electrical connector adapted for mating with a complementary connector having a shield, comprising:

an insulative housing comprising a base and a mating portion extending from the base, the mating portion defining a receiving cavity and at least one fixing portion;

a plurality of terminals mounted to the housing with contact portions disposed in the receiving cavity;

a metallic shell attached to the insulative housing; and at least one grounding bridge having a body portion retained in the at least one fixing portion, a contact portion extending inwardly from an upper portion of the body portion, and a fastening portion extending horizontally from the bottom of the body portion, the metallic shell abutting against the fastening portion of the at least one grounding bridge, the contact portion of the grounding bridge extending beyond an upper portion of the housing for engaging with the shield of the mating connector before the terminals electrically connect with contacts of the mating connector; wherein the at least one grounding bridge includes a pair of wings extending from opposite sides of the body portion, and wherein the housing defines a retaining recess extending outwardly from an inner portion of antecedent basis for retaining the wings therein; wherein the insulative housing defines a notch in an upper portion thereof, and wherein the grounding bridge includes a shift portion extending from a free end of the contact portion and resiliently movable in the notch.

* * * * *